US007585154B2

(12) United States Patent
Lan et al.

(10) Patent No.: US 7,585,154 B2
(45) Date of Patent: Sep. 8, 2009

(54) CENTRIFUGAL FAN AND IMPELLER THEREOF

(75) Inventors: Chung-Kai Lan, Taoyuan Hsien (TW); Huan-Chi Chen, Taoyuan Hsien (TW); Te-Tsai Chung, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 34 days.

(21) Appl. No.: 11/376,134

(22) Filed: Mar. 16, 2006

(65) Prior Publication Data

US 2007/0110573 A1 May 17, 2007

(30) Foreign Application Priority Data

Nov. 11, 2005 (TW) ..... 94139630 A

(51) Int. Cl.
*B64C 11/00* (2006.01)

(52) U.S. Cl. ..... 416/175; 416/178; 416/203

(58) Field of Classification Search ..... 415/206; 416/175, 178, 203
See application file for complete search history.

(56) References Cited

U.S. PATENT DOCUMENTS

| | | | | |
|---|---|---|---|---|
| 7,125,226 | B2 * | 10/2006 | Horng et al. | 416/203 |
| 7,134,839 | B2 * | 11/2006 | Horng et al. | 415/199.4 |
| 2002/0122724 | A1 * | 9/2002 | Tseng | 416/175 |
| 2006/0034694 | A1 * | 2/2006 | Li et al. | 416/175 |

* cited by examiner

*Primary Examiner*—Edward Look
*Assistant Examiner*—Dwayne J White
(74) *Attorney, Agent, or Firm*—Birch, Stewart, Kolasch & Birch, LLP

(57) ABSTRACT

An impeller applied to a centrifugal fan includes a base plate, a hub and a plurality of first blades. The hub is connected to the base plate and the first blades are disposed on the base plate with respect to the hub as a center. Furthermore, the hub has a plurality of second blades disposed around its outer wall to enhance its performance. A centrifugal fan including the impeller is also disclosed.

16 Claims, 4 Drawing Sheets

CENTRIFUGAL FAN AND IMPELLER THEREOF

BACKGROUND OF THE INVENTION

1. Field of Invention

The invention relates to a fan and, in particular, to a centrifugal fan.

2. Related Art

Since the present electronic products are rapidly developed towards high performance, high frequency, high speed and compactness, the generated heat of the electronic products becomes greater. However, the electronic products are unstable in the high temperature, which affects the reliability thereof. Thus, the heat dissipation has become an important issue of the present electronic products.

The fan is a common heat dissipating device for the electronic product. As shown in FIG. 1, a conventional centrifugal fan 1 includes an impeller 11 and a motor 12. The impeller 11 includes a base plate 113, a hub 111 disposed at the center of the base plate 113, and a plurality of blades 112. The base plate 113 is connected to the hub 111, and the blades 112 are disposed on the base plate 113 with respect to the hub 111 as a center. The blades 11 further includes a connecting ring 114, which is connected to a side of the blades 112 opposite to another side thereof facing the base plate 113. The motor 12 is accommodated in the hub 111 for driving the impeller 11 to rotate.

When the impeller 11 rotates, airflow enters the center of the impeller 11. Then, the rotated blades 112 force the airflow to radiately flow out of the blades 112. Since the airflow may have the counterflow, backflow, and separation phenomenon in the impeller 11, the flow field after entering the impeller 11 becomes very complicated.

In more details, since the speed of the airflow near the hub 111 is lower than that at other places, the utility efficiency of the airflow near the hub 111 is poor. If this utility efficiency is appropriately enhanced, the performance of the whole fan can be better so as to increase the heat dissipation effect. It is therefore an important subject of the invention to improve the entire working efficiency of the centrifugal fan and the impeller thereof for obtaining higher heat dissipation effect.

SUMMARY OF THE INVENTION

In view of the foregoing, the invention is to provide a centrifugal fan and an impeller thereof that can efficiently improve the entire working efficiency for enhancing the heat dissipation effect.

To achieve the above, an impeller of the invention is applied to a centrifugal fan and includes a base plate, a plurality of first blades, and a hub. The first blades are disposed on the base plate with respect to the hub as a center. The hub is connected to the base plate, and has a plurality of second blades disposed around an outer wall of the hub.

To achieve the above, a centrifugal fan of the invention includes an impeller and a motor. The impeller includes a base plate, a hub, and a plurality of first blades. The first blades are disposed on the base plate with respect to the hub as a center. The hub is connected to the base plate, and has a plurality of second blades disposed around an outer wall of the hub. The motor is coupled to the impeller for driving the impeller to rotate.

As mentioned above, the centrifugal fan and impeller of the invention have a plurality of second blades disposed around the outer wall of the hub. Due to the second blades, the utility efficiency of the airflow near the hub can be appropriately enhanced so as to increase the heat dissipation effect. Furthermore, the centrifugal fan of the invention may have the superior performance at a high air pressure area.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
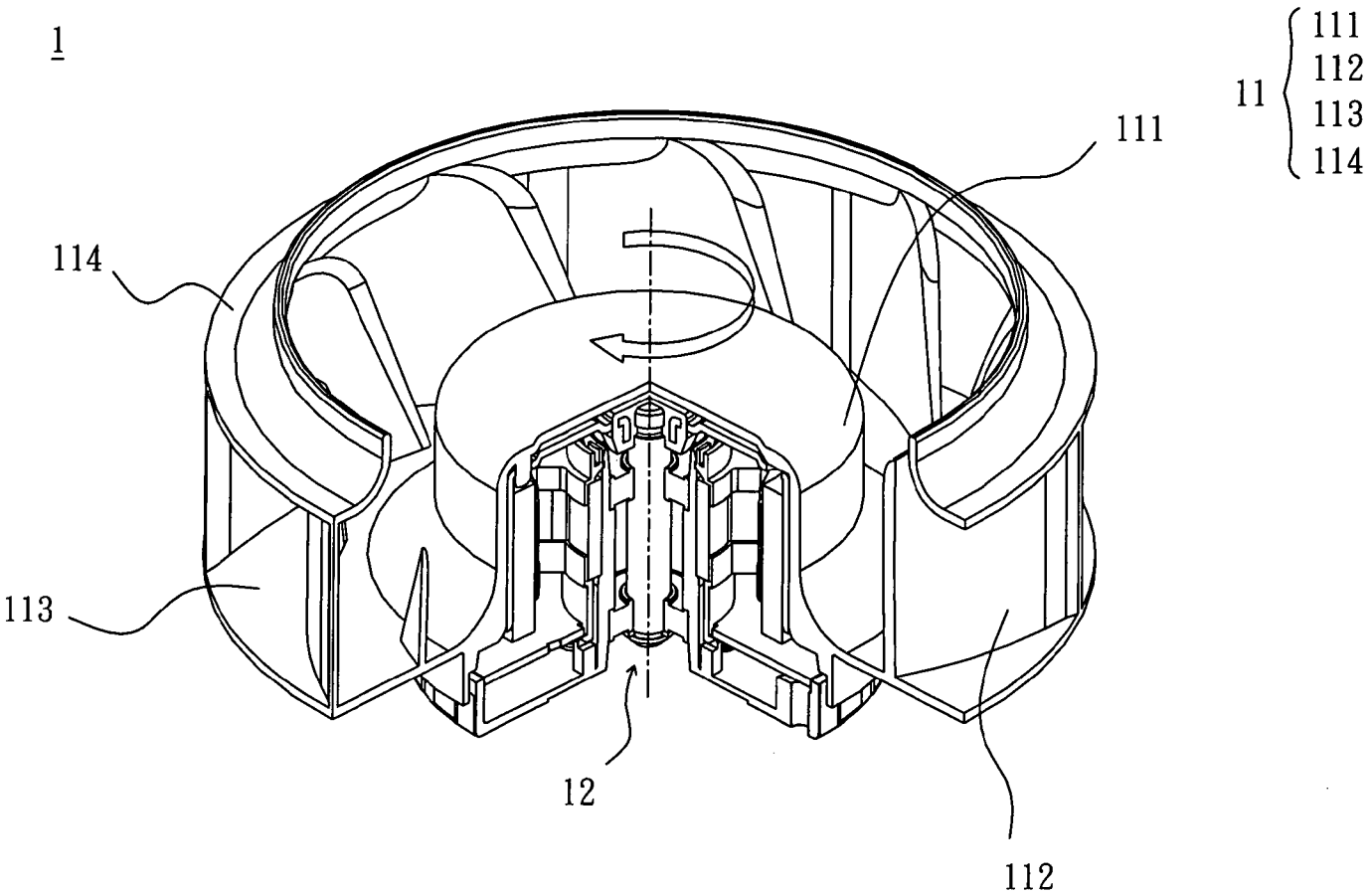
PRIOR ART FIG. 1
FIG. 1 is a schematic view of the conventional centrifugal fan.
Figure 2:
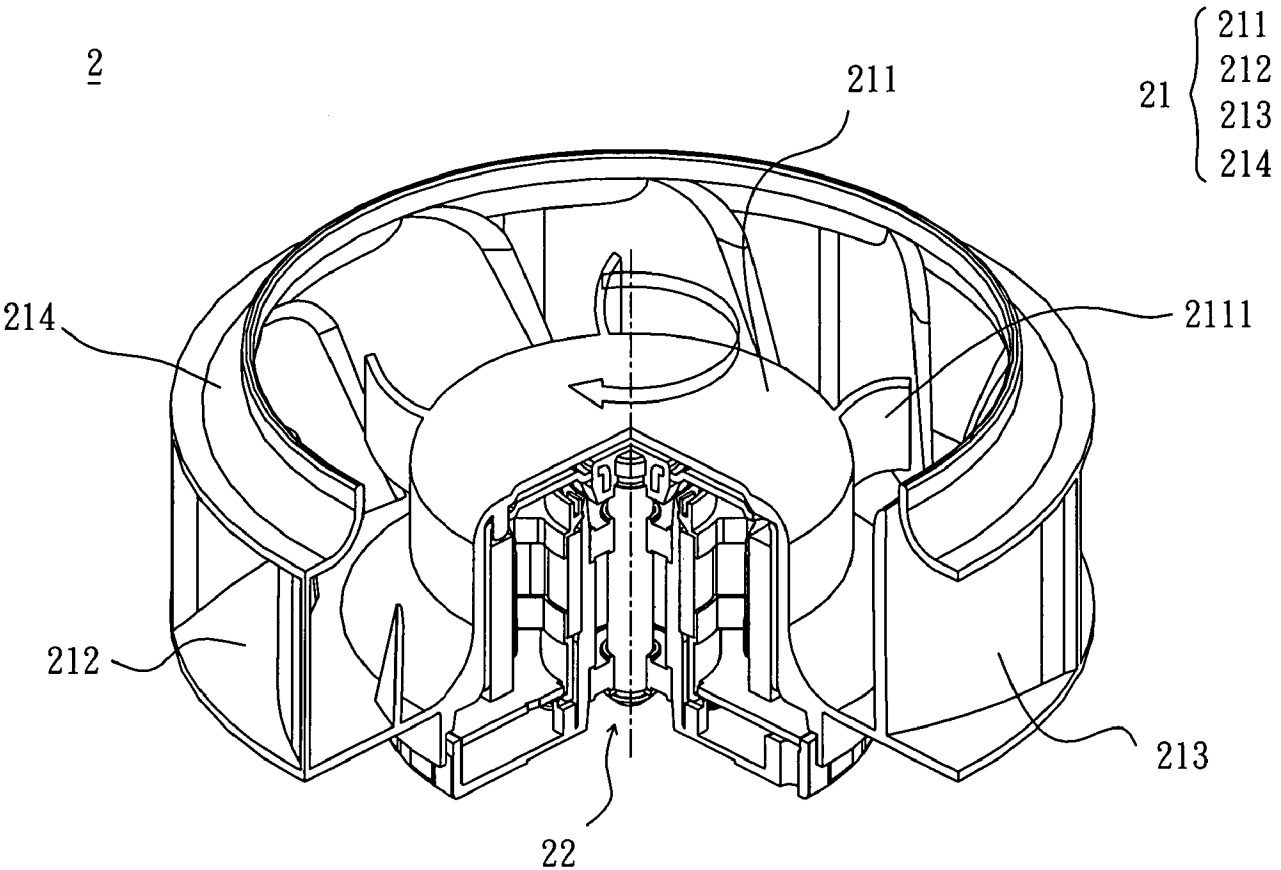
FIG. 2 is a three dimensional view of a centrifugal fan according to a preferred embodiment of the invention.

FIG. 2 is a three dimensional view of a centrifugal fan and an impeller thereof according to a preferred embodiment of the invention. As shown in FIG. 2, the centrifugal fan 2 includes an impeller 21 and a motor 22. The impeller 21 includes a base plate 212, a hub 211, and a plurality of first blades 213. The motor 22 is accommodated in the hub 211 for coupling to the impeller 21 and driving it to rotate. The hub 211 is connected to the base plate 212. The first blades 213 are disposed on the base plate 212 with respect to the hub 211 as a center. The hub 211 has a plurality of second blades 2111 disposed around its outer wall. In the embodiment, the base plate 212 is ring-shaped, and the base plate 212, the hub 211 and the first blades 213 are integrally formed as a single unit. The second blades 2111 are forward leaning blades and the hub 211 and the second blades 2111 are integrally formed as a single unit. In other words, the second blades 2111, the hub 211, the base plate 212 and the first blades 213 are integrally formed as a single unit. To be noted, the second blades 2111 still can either be backward leaning blades or in any other curved shape. A plane parallel to the base plate 212 intersects the first blades 213 and the second blades 2111.

The impeller 21 further includes a connecting ring 214, which is connected to a side of the first blades 213 opposite to another side thereof facing the base plate 212. In the embodiment, the connecting ring 214 and the first blades 213 integrally formed. Moreover, please refer to FIGS. 2 and 3, the first blades 213 and the second blades 2111 are both located substantially perpendicularly to the base plate 212. The impeller 21 is the centrifugal impeller. The first blades 213 and the second blades 2111 are the centrifugal blades.

Figure 3:
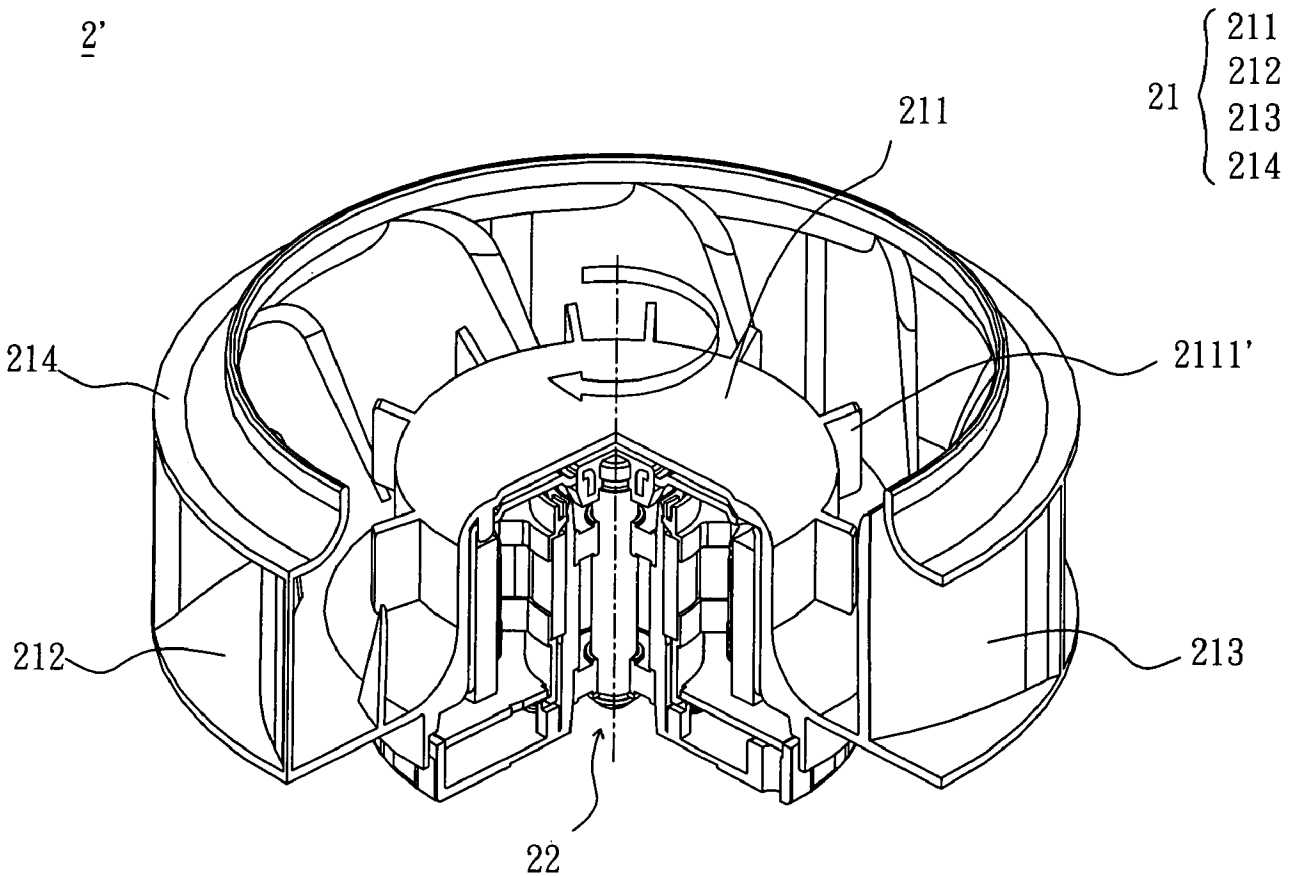
FIG. 3 is a three dimensional view of another centrifugal fan according to the preferred embodiment of the invention.

FIG. 3 is a three dimensional view of another centrifugal fan and the impeller thereof according to the preferred embodiment of the invention. With reference to FIG. 3, a centrifugal fan 2' has a plurality of second blades 2111' in plate shapes. Except the shapes and number of the second blades 2111', the elements in the centrifugal fan 2' are the same as those in FIG. 2.

Figure 4:
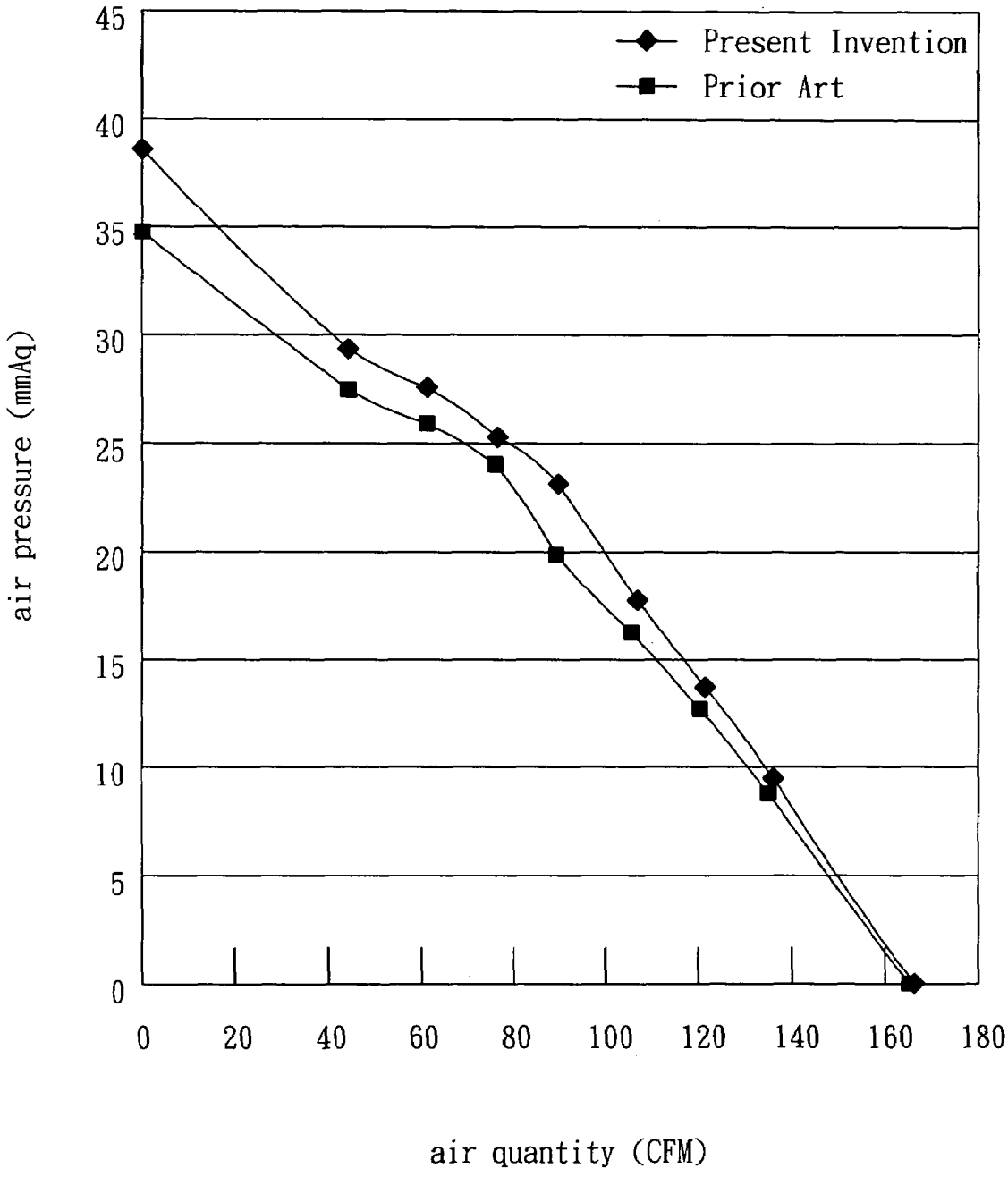
FIG. 4 is a schematic diagram showing efficiency curves of the conventional centrifugal fan and the centrifugal fan according to the preferred embodiment in FIG. 3.

With reference to FIG. 4, an experimental analysis by comparing the conventional centrifugal fan and the centrifugal fan of the invention as shown in FIG. 3 is obtained. The X axis represents the airflow quantity, and the Y axis represents the air pressure. Under the same rotation speed of 4060 RPM, the centrifugal fan of the invention can produce higher air pressure and larger airflow quantity. More particularly, the increase of the air pressure is much obvious. According to the experimental analysis, the centrifugal fan of the invention can provide more working efficiency than the conventional one.

In these embodiments, the second blades 2111 or 2111' and the first blades 213 are, but not limited to, forward leaning blades, backward leaning blades, plate blades, or their combinations. The number of the second blades 2111 or 2111' is not limited and is unnecessary to have an absolute relation with the number of the first blades 213. In addition, the positions of the second blades 2111 or 2111' are unnecessary to have a relation with the positions of the first blades 213. In conclusion, the shapes and number of the second blades and the relationship between the first and second blades are determined according to the actual needs.

In summary, the centrifugal fan and impeller of the invention have a plurality of second blades disposed around the outer wall of the hub. Due to the second blades, the utility efficiency of the airflow near the hub can be appropriately enhanced so as to increase the heat dissipation effect. Furthermore, the centrifugal fan of the invention may have the superior performance at the high air pressure area.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An impeller comprising:

a base plate;

a plurality of first blades disposed on the base plate; and a hub connected to the base plate and having a plurality of second blades connected to an outer wall of the hub;

wherein the second blades are separated from the first blades, and the second blades, the hub, the base plate and the first blades are integrally formed as a single unit, and wherein the first blades and the second blades are both located substantially perpendicularly to the base plate, and the edge side of each of the second blades, faced to the first blades, extends substantially perpendicularly to the base plate.

2. The impeller of claim 1, wherein each of the second blades is selected from the group consisting of a forward leaning blade, a backward leaning blade, and a plate blade.

3. The impeller of claim 1, wherein the base plate is ring-shaped.

4. The impeller of claim 1, further comprising:

a connecting ring connected to a side of the first blades opposite to another side of the first blades facing the base plate.

5. The impeller of claim 4, wherein the connecting ring and the first blades are integrally formed.

6. The impeller of claim 1, wherein a plane parallel to the base plate intersects the first blades and the second blades.

7. A centrifugal fan comprising:

an impeller comprising a base plate, a hub, and a plurality of first blades, wherein the first blades are disposed on the base plate and around the hub, and the hub is connected to the base plate and has a plurality of second blades connected to an outer wall of the hub; and a motor coupled to the impeller for driving the impeller to rotate;

wherein the second blades are separated from the first blades, and the second blades, the hub, the base plate and the first blades are integrally formed as a single unit, and wherein the first blades and the second blades are both located substantially perpendicularly to the base plate, and the upper side of each of the second blades extends substantially parallel to the base plate.

8. The centrifugal fan of claim 7, wherein each of the second blades is selected from the group consisting of a forward leaning blade, a backward leaning blade, and a plate blade.

9. The centrifugal fan of claim 7, wherein the base plate is ring-shaped.

10. The centrifugal fan of claim 7, wherein the motor is accommodated in the single hub.

11. The centrifugal fan of claim 7, further comprising:

a connecting ring connected to a side of the first blades opposite to another side of the first blades facing the base plate.

12. The centrifugal fan of claim 11, wherein the connecting ring and the first blades are integrally formed.

13. The centrifugal fan of claim 7, wherein a plane parallel to the base plate intersects the first blades and the second blades.

14. A centrifugal impeller comprising:

a base plate;

a plurality of first centrifugal blades disposed on the base plate;

a hub connected to the base plate and having a plurality of second centrifugal blades disposed around an outer wall of the hub; and a connecting ring connected to the side of the first centrifugal blades opposite to another side of the first centrifugal blades facing the base plate;

wherein the second centrifugal blades are separated from the first centrifugal blades, and the edge side of each of the second centrifugal blades, faced to the first blades, extends substantially parallel to the outer side of each of the first centrifugal blades.

15. The centrifugal impeller of claim 14, wherein the connecting ring and the first centrifugal blades are integrally formed.

16. The centrifugal impeller of claim 14, wherein the centrifugal impeller is applied to a centrifugal fan.

* * * * *